US005338032A

United States Patent [19]

Latham

[11] Patent Number: 5,338,032

[45] Date of Patent: Aug. 16, 1994

[54] DART GAME "OUTS" INDICATING DEVICE

[76] Inventor: William C. Latham, 56611 Colerain Pike, Martins Ferry, Ohio 43935

[21] Appl. No.: 22,503

[22] Filed: Feb. 25, 1993

[51] Int. Cl.[5] ..... F41J 5/04

[52] U.S. Cl. ..... 273/148 R; 273/371; 273/376; 340/323 R

[58] Field of Search ..... 273/317, 371, 376, DIG. 26, 273/148 R, 54 R, 54 C, 14; 340/323 R; 364/411

[56] References Cited

U.S. PATENT DOCUMENTS

| | | | |
|---|---|---|---|
| 4,286,323 | 8/1981 | Meday | 364/411 |
| 4,427,199 | 1/1984 | Faith | 273/371 |
| 4,567,461 | 1/1986 | Honekman et al. | 340/323 R |
| 4,900,027 | 2/1990 | Sheridan | 273/148 R |
| 4,948,125 | 8/1990 | Mayes | 273/148 R X |
| 4,974,857 | 12/1990 | Beall et al. | 273/371 |
| 5,020,806 | 6/1991 | Martin | 273/371 |
| 5,054,792 | 10/1991 | Danielson | 273/408 |
| 5,134,565 | 7/1992 | Herbertz | 364/411 |
| 5,156,643 | 10/1992 | Grubek | 273/376 |
| 5,181,009 | 1/1993 | Perona | 340/407 |

*Primary Examiner*—Jessica J. Harrison
*Assistant Examiner*—Kerry Owens
*Attorney, Agent, or Firm*—Lee A. Germain; Ray L. Weber

[57] ABSTRACT

This invention provides an electronics device applicable to the well-known and understood "01" dartboard games which provides a display of the highest percentage target scores a darts player may use to gain an "out" in the shortest manner and win the game. A microprocessor within the device interrogates a memory store containing a lookup table of scores within a particular range and provides a selection of target score "outs" which the player may use to "out" from the score points that he happens to have at the time.

14 Claims, 1 Drawing Sheet

FIG.-1
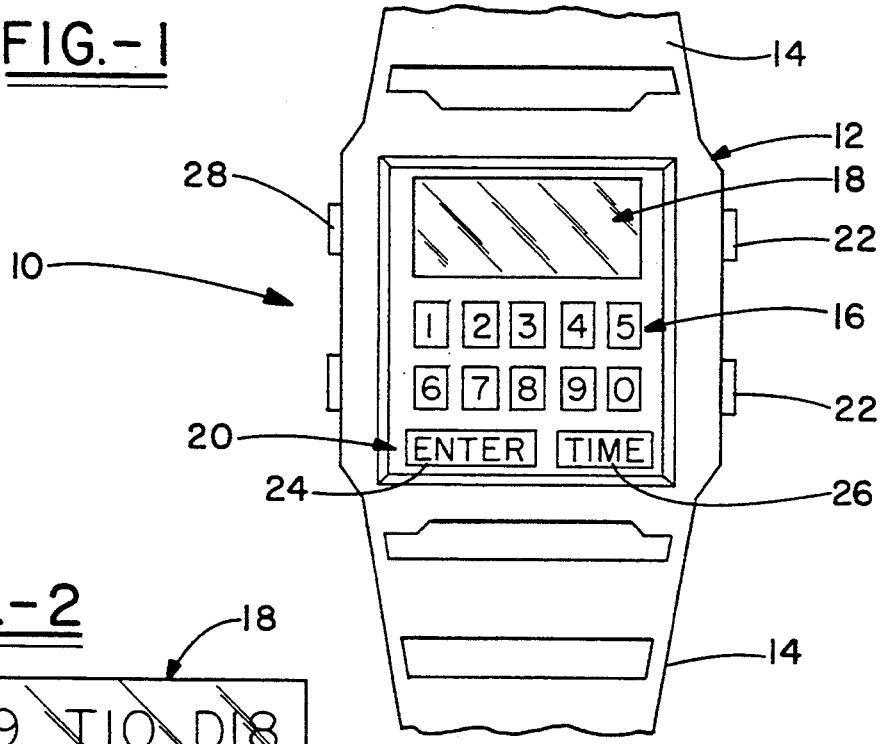
FIG.-2
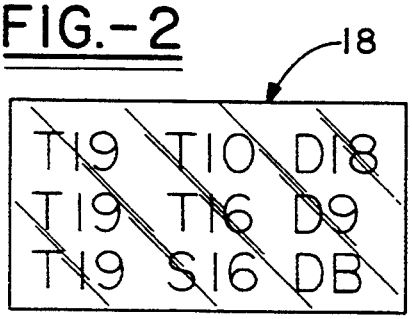
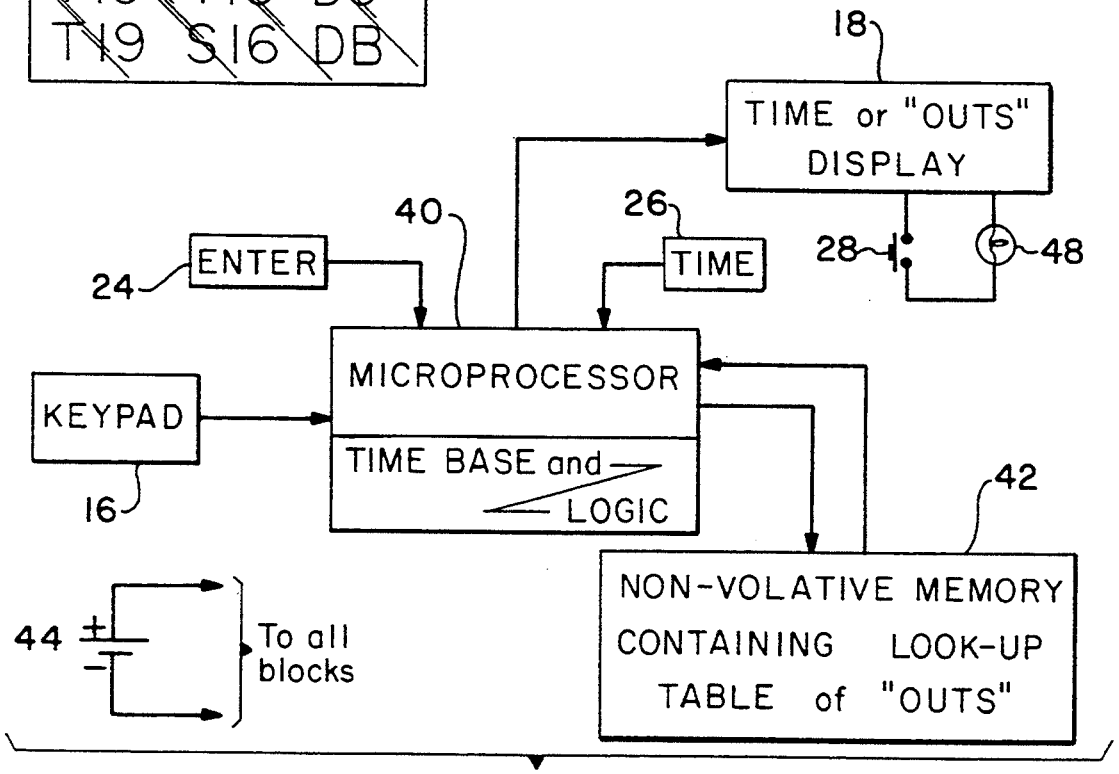
FIG.-3

DART GAME "OUTS" INDICATING DEVICE

FIELD OF THE INVENTION

This invention pertains to dartboard games and, more particularly, to a device which provides a dart player, i.e. a darter, an immediate indication of what dartboard target scores he may use to achieve the shortest "out" in any of the well-known and understood "double-out 01" dartboard games.

More specifically, this invention provides a miniature device which, when interrogated by a particular dartboard score entry, will provide a display selection of the highest percentage target scores one may use to achieve an "out" in the shortest manner and win in the sport game of "double-out 01" darts.

BACKGROUND OF THE INVENTION

Competitive dartboard games are played and enjoyed in many countries of the world and the most notable of these are the ones known and understood as "501" and "301" darts. According to either of these dartboard games, a darter may or may not be required to "double-in" to start the game but in both he must "double-out", that is, he must hit a double target score to finish the game. In 301, for example, a darter starts with 301 points and each subsequent score is subtracted from his previous score until he achieves a score of "0" having hit a double target score to reach "0".

It is, of course, assumed here that the reader is familiar with conventional dartboard displays which will have numerical values from 1–20 affixed to pie-shaped segments of a circular target and about a "bullseye" at the center and various portions of the target display are used for obtaining (1) a single value of a numbered target score, (2) a doubled value of a numbered target score, and (3) a tripled value of a numbered target score.

Persons who regularly compete in dartboard games of the type alluded to above, know and understand what target score sequences are required to gain an "out" from a particular level of score. For example, if a darter has reached a score level of 170 points, the shortest and thus also the fastest "out" comprises just three target scores and these are a triple-20, another triple-20 and, a double-bullseye. In other words, a triple-20 target score results in a deduction of 60 points from 170 leaving a remainder score of 110. A second triple-20 will reduce 110 to 50 points remainder. Because the darter must "double-out" to finish the game, a double-bull, i.e., 25 points doubled, will allow him to finish the game in the shortest and fastest manner.

The above scenario assumes, of course, that the darter posses such skill in the art of dart throwing that he may achieve each of the above-described target scores. Of course, few persons are that skilled as to guarantee a particular score at any particular time in an event. For example, as skilled as a bowler may be, he may bowl the ultimate "300" game only a few times, if at all, in a career. Similarly and with reference to the example given above, a few darters posses the level of skill to achieve a three dart "out" as described. For example, if the darter is successful in scoring the first triple-20 but fails to score the second triple-20, his "out" will be something different and he cannot achieve the "out" by scoring a double-bull. By the same token, if he achieves scoring both of the triple-20's but fails to score the double-bull, he must "out" in another manner. Because a darter's dartboard score may change from one dart throw to the next his total score will also change and this affects what particular "outs" are available to him. It is, therefore, unlikely that most novice darters will know or remember what highest percentage "outs" are available from any particular score level.

It is, therefore, in accordance with one aspect of the present invention an object to provide a device which gives a dartboard player an indication of the highest percentage "outs" so that if achieved, he may win in any of the "01" dartboard games.

In accordance with another aspect of the invention it is an object to provide an electronics device which displays the highest percentage "outs" which are available to a darter when he has achieved a dartboard score of at least 170 points in any of the "Double-Out 01" dartboard games.

According to still another aspect of the invention it is an object to provide an electronics device in a wrist mountable format, which device provides a display indication of the highest percentage "outs" that a darter may use for winning in any of the "01" dartboard games.

In accordance with another aspect of the invention it is an object to provide a miniature electronics device which normally functions as a wristwatch displaying clock time indications and which may be converted to provide a display selection of the highest percentage "outs" a darter may use to achieve zero points in either of the "double-out" 501 and/or 301 dartboard games.

SUMMARY OF THE INVENTION

These objects and other objects and advantages of the invention are achieved in a miniature electronics device comprising a microprocessor having a memory store containing a lookup table of dartboard scores within a particular range of scores and an associated plurality of target score "outs" that may be used to gain zero score points from each of the plurality of dartboard scores of the range, the device also comprising a means to enter a specific dartboard score to interrogate the memory and a means to display the selection of highest percentage "outs" for the score entry such that a darter may select a particular one "out" of the selection and, if successfully achieved, attain zero score points in the shortest and fastest manner possible to win the game.

BRIEF DESCRIPTION OF THE DRAWINGS

The various features and advantages of the invention will become readily apparent and better understood from a consideration of the following detailed description when taken in conjunction with the accompany drawing, in the several figures in which like-reference numerals are used to identify like elements and wherein:

FIG. 1 is a plan view of the preferred form of the invention in a wrist-wearable device illustrating various features which are used to accomplish the objects of the invention;

FIG. 2 is a greatly enlarged plan view of the display of the device shown in FIG. 1 illustrating a selection of highest percentage "outs" a dartboard player may use to gain zero score points from a total dartboard score of 123 points; and FIG. 3 is an electronics block diagram schematically illustrating various elements comprising the device of the invention for achieving the results claimed.

DETAILED DESCRIPTION OF THE INVENTION

Referring to FIG. 1 of the drawings, a device according to the invention is illustrated and generally indicated by reference numeral 10. The device 10 comprises a housing 12 which may be of any configuration to meet the needs of the invention but it is shown preferably as including a pair of straps 14 such that the device may be worn on a person's wrist in the manner of a conventional wristwatch. The device 10 includes a ten-digit keypad 16, a liquid crystal display 18 and, mode keys 20 for controlling the functions of the device 10. Other button keys 22 may also be provided to control various others functions which may be incorporated into the device 10 and these will be described hereinafter.

Referring now also to FIG. 3 of the drawings, a block diagram schematic illustrating the functional elements which comprise the invention are shown and these include a microprocessor 40 which interfaces with a keypad 16, a display 18, a non-volative memory 42, and a power source 44. The memory 42 comprises a digital store configured to contain a look-up table of all of the highest percentage "outs" which may be available with reference to any dartboard score below a specific upper limit. Because the invention is directed to the internationally known "01" dartboard games including "501" and "301" wherein a requirement exists that a darter must "out" on a "double score", the memory store of "outs" contains only those including a "double" as the final "out" Further, and so as to establish a limit to the number and and length of the "outs" for a particular score, only those scores below 171 points are included in the memory 42. In this respect, it will be recognized that any score level may be used as a cutoff level and this invention, therefor, is not considered limited to a particular level or to the score level given in this specification. The upper cutoff score level merely reduces the amount of memory required to store all of the highest percentage "outs" and may be changed to suit the designer. In any event and as a practical matter, this invention has limited the number of "outs" in the memory 42 to score levels within the range of "02–170" inclusive. Obviously, for the lower-score levels the number and length of the "outs" will be fewer and shorter respectively than for the higher level scores.

The operation of the invention will be described with reference now also to FIG. 2 of the drawings wherein the "outs" for a particular score level are illustrated as these may appear in the device display 18 shown in FIG. 1. Let us say, for example, that a dartboard player has achieved a score level of "123" points. A mode switch 24 is pressed on the device 10 to establish the game mode and then he enters his score "123" via the keypad switches 16. The microprocessor 40 interrogates the memory 42 which provides an output indicative of the highest percentage "outs" that may be used to "out" from 123. These are transferred out of memory to the display 18 which appear in the format shown in FIG. 2. The particular high percentage "outs" for a score of "123" are (1) triple-19, triple-10, double-18, (2) triple-19, triple-16 double-9, and (3) triple-19, single-16, double-bull. It can be seen that any of these may be used to achieve the "out" and this may be shown by the numerical equations (1) $123-57-30-36=0$, (2) $123-57-48-18=0$, and (3) $123-57-16-50=0$ respectively.

It will be recognized that one may not achieve the particular "out" if he fails to make any one of the particular target scores for the "out". For example, if a darter achieves a dartboard score of 154 points, there is but a single high percentage and fast "out" which he may use to win the game. This "out" comprises a triple-20, triple-18, and a double-20, i.e., $154-60-54-40=0$ which will be displayed as "T20 T18 D20". Should the darter fail to make any one of the three target scores his total will change. For example, if he makes a single-2 rather than a triple-20, his new total score will be $154-2=152$. He must now enter this new score into the device 10 whereupon a new set of "outs" will appear in the display 18. Oddly enough, the new "outs" for a score of 152 comprise a single "out" which is "T20 T20 D16" or numerically stated $152-60-60-32=0$. Again, if the darter fails to make any of these three target scores, his total will change and he must enter the new score into the device 10. Thus, it can be appreciated that the device 10 of this invention meets the needs of a dartboard player by providing an almost immediate indication of the highest percentage "outs" which he may use in the competitive sport of "01 darts".

While the invention is preferably in the format of a wrist-worn device 10 as illustrated in FIG. 1 of the drawings, it will be recognized that other types of format may be used to meet the needs of the invention. For example, a handheld calculator configuration may be used as these are known and available in the art and the particular aesthetic configuration irrespective of format is not a lifting factor in this invention. However, it will also be apparent to those who are knowledgeable in the dartboard game sport that a wrist-worn configuration presents a more convenient and available format to the darter when involved in a competition. In this respect also, it is anticipated that various designs for the face of the device 10 may be used and this invention is not considered limited to the particular one illustrated in FIG. 1 of the drawings.

In addition to the dartboard game function as hereinbefore described, it is anticipated that a device 10 may be configured to include a conventional time mechanism as may be found in the digital watch art. In this respect, the microprocessor 40 will include a time-based crystal or other time-base mechanism and any required digital logic necessary for a time indication in the display 18. In addition time-mode switching may be provided by a touch pad 26 as well as conventionally applied set and reset button switches 22 illustrated in FIG. 1. Further and to facilitate viewing of the display 18 in a dimly lighted area, a miniature light source 48 may be provided along with a button switch 28. Of course, all of these additional functions are well within the state of the digital watch art and whether or not they are included within the device 10 is a matter for the designer to decide.

While certain representative details have been shown and described for the purposes of this description, it will be apparent to those persons skilled in the various arts which may pertain to the invention that changes and/or modifications may be made therein and thereto without departing from the spirit or scope of the invention.

I claim:

1. A device for indicating the "outs" used by a dartboard player to achieve a zero score in any of the double-out "01" dartboard games comprises in combination:

a housing;

a numerical keypad within the housing;

a display means within the housing;

a microprocessor within the housing having a memory store containing a lookup table of "outs" that may be used for each one of a plurality of dartboard scores; and a power source and means electrically interconnecting the keypad, display means, and the microprocessor enabling a particular dartboard score entry to interrogate the memory and said microprocessor provides a selection of "outs" for that score entry to the display means.

2. The device as claimed in claim 1 wherein the memory store contains a lookup table of "outs" for dartboard scores within the range of 002–170 points.

3. The device as claimed in claim 1 further comprising a light source within the housing and a switch means to provide selective illumination of the display means.

4. The device as claimed in claim 1 wherein the housing includes a means for attaching said device to a player's wrist.

5. The device as claimed in claim 1 wherein the microprocessor further comprises a time base and logic to provide a clock output to the display means.

6. The device as claimed in claim 1 wherein the display means is a liquid crystal display.

7. A device for indicating the "outs" used by a dartboard player to achieve a zero score in any of the double-out "01" dartboard games comprises in combination:

a housing including a means for attaching said device to a player's wrist;

a numerical keypad within the housing;

a display means within the housing;

a microprocessor within the housing having a memory store containing a lookup table of "outs" for each one of a plurality of dartboard scores within the range of 002–170 points; and a power source and means electrically interconnecting the keypad, display means, and the microprocessor enabling a dartboard score entry to interrogate the memory and the microprocessor provides a selection of "outs" for that entry to the display means.

8. The device as claimed in claim 7 wherein the microprocessor further comprises a time base and logic to provide a clock output to the display means.

9. The device as claimed in claim 7 further comprising a light source within the housing and a switch means to provide selective illumination of the display means.

10. The device as claimed in claim 8 further comprising mode switches which effect a conversion from a normal clock output display to a dartboard game display of the selection of "outs".

11. A device used by a dartboard player when competing in any of the "double-out 01" dartboard games comprises in combination:

a housing having strap means for attachment to a player's wrist;

a ten digit numerical keypad within the housing;

a liquid crystal display within the housing;

microprocessor means within the housing including a memory store containing a look-up table of "outs" for each one of a plurality of dartboard scores within a particular score range; and a power source and means electrically interconnecting the keypad, display, and microprocessor enabling a keypad numerical entry indicative of a particular dartboard score within the range to effect interrogating of the memory and the microprocessor provides a selection of target score "outs" to the display any one of which may be used by the player to achieve a zero dartboard score.

12. The device as claimed in claim 11 wherein the microprocessor further comprises a time base and logic to provide a clock output to the display in the normal functioning of the device and mode switching means are provided to switch from a clock display to a target score "outs" display.

13. The device as claimed in claim 11 further comprising a light source within the housing and a switch means providing selective illumination of the display.

14. The device as claimed in claim 11 wherein the plurality of dartboard scores are within the score range of 02–170 points inclusive.

* * * * *